US006655458B2

(12) United States Patent
Kurkjian et al.

(10) Patent No.: US 6,655,458 B2
(45) Date of Patent: Dec. 2, 2003

(54) FORMATION TESTING INSTRUMENT HAVING EXTENSIBLE HOUSING

(75) Inventors: Andrew L. Kurkjian, Sugar Land, TX (US); John B. Elmer, Houston, TX (US); William B. Underhill, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 70 days.

(21) Appl. No.: 09/992,144

(22) Filed: Nov. 6, 2001

(65) Prior Publication Data

US 2003/0085035 A1 May 8, 2003

(51) Int. Cl.[7] ..... E21B 47/00

(52) U.S. Cl. ..... 166/254.2; 166/206; 166/250.17; 175/97

(58) Field of Search ..... 166/254.2, 250.01, 166/254.1, 250.16, 250.17, 206; 175/94, 97, 106

(56) References Cited

U.S. PATENT DOCUMENTS 4,228,350 A * 10/1980 Paap et al.
4,252,195 A 2/1981 Fredd
4,349,072 A * 9/1982 Escaron et al.
4,432,143 A * 2/1984 Moriarty et al.
4,600,059 A 7/1986 Eggleston et al.
4,624,313 A 11/1986 Coshow
4,697,638 A * 10/1987 Knight
4,860,580 A * 8/1989 Du Rocher
4,914,826 A * 4/1990 Nold
4,936,139 A 6/1990 Zimmerman et al.
5,168,765 A * 12/1992 Broussard
5,217,075 A * 6/1993 Wittrisch
5,574,263 A * 11/1996 Roesner
5,753,813 A 5/1998 Hagiwara
5,808,191 A * 9/1998 Alexy et al.
5,954,131 A 9/1999 Sallwasser
6,058,773 A 5/2000 Zimmerman et al.
6,179,055 B1 1/2001 Sallwasser et al.

FOREIGN PATENT DOCUMENTS

EP 0 346 229 A1 * 12/1989

* cited by examiner

*Primary Examiner*—Roger Schoeppel
(74) *Attorney, Agent, or Firm*—Jennie (JL) Salazar; Briditte L. Jeffery; John J. Ryberg

(57) ABSTRACT

A well logging instrument is disclosed which includes a housing operatively coupled to a well logging conveyance and movable within the wellbore. The housing has therein a formation testing system and an axial extension mechanism. The axial extension mechanism controllably extends and retracts to allow the formation testing system to perform tests and take samples in an axially fixed position in the wellbore while the housing moves through the wellbore.

22 Claims, 6 Drawing Sheets

FORMATION TESTING INSTRUMENT HAVING EXTENSIBLE HOUSING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of wellbore testing and sample taking instruments. More particularly, the invention relates to designs for such instruments which reduce a possibility of the instrument and/or conveyance device becoming stuck in a wellbore.

2. Background Art

When drilling a wellbore through earth formations for the purpose of producing hydrocarbons, frequently the wellbore operator requires information concerning formation and wellbore parameters, such as fluid pressure and fluid content of the various formations penetrated by the wellbore. Such pressure and fluid content information is used for, among other purposes, determining a depth at which to set casing, determining which formations are likely to be commercially productive of hydrocarbons or whether to set casing at all.

Various instruments are known in the art for taking formation fluid pressure measurements and/or formation fluid samples. Many of these instruments are designed to be conveyed at one end of an armored electrical cable ("wireline" conveyed). Other types of instruments may be conveyed by coiled tubing, drill pipe or similar conveyances. These instruments typically include an elongated instrument housing adapted to traverse the wellbore. The instrument housing includes therein a probe adapted to be extended from the housing and placed in externally sealed engagement with the wall of the wellbore at the position of a formation to be tested. Various flowlines, pressure transducers and sample chambers are disposed in the instrument housing and are adapted to cause fluid to be withdrawn from the selected formation while pressure and fluid composition properties are measured. In some cases a sample of the formation fluid will be directed to a storage tank for ultimate removal from the wellbore and subsequent analysis at the earth's surface. Examples of such formation pressure measuring and sample testing instruments are described in U.S. Pat. No. 6,058,773 issued to Zimmerman et al. and U.S. Pat. No. 4,936,139 issued to Zimmerman et al.

One particular concern associated with substantially all formation pressure measuring and sampling instruments such as the ones described in the above references is that the instrument must be stopped in the wellbore in order to take a sample and/or make a pressure measurement. Stopping the instrument in the wellbore substantially increases the risk of the instrument and/or means of conveyance becoming stuck in the wellbore. Mechanisms for becoming stuck include debris settling out of the drilling fluid and lodging between the instrument and the wellbore wall, differential pressure between the drilling fluid in the wellbore and the formation being tested, and the conveyance becoming "keyseated" in the wall of the wellbore. So called "tractor" devices have been developed to prevent wellbore tools from sticking in the wellbore. Examples of such tractor devices include U.S. Pat. No. 5,954,131 issued to Sallwasser on Sep. 21, 1999 and U.S. Pat. No. 6,179,055 issued to Sallwasser et al. on Jan. 30, 2001, the entire contents of both are hereby incorporated by reference. These tractor devices convey a tool along a wellbore using a cam system to lock against the borehole wall.

What is needed is a device for enabling continued motion of the conveyance and a substantial portion of the instrument while the tool conducts wellbore operations, such as deploying a probe to make a formation pressure measurement and/or fluid test. One such device is described for example in U.S. Pat. No. 4,600,059 issued to Eggleston et al. The device disclosed in this reference includes a telescoping section coupled between a wireline conveyed fluid testing instrument and the armored electrical cable. When the testing instrument is deployed to test a particular earth formation, and is thus stationary, the armored electrical cable may be kept in continuous motion by repeated extension and retraction of the telescoping section. This is known in the art as "yo-yoing" the cable. Yo-yoing the cable requires the cable operator to pay very close attention to a winch control system to avoid too much upward and/or downward motion of the cable for operating the telescoping section. It is desirable to have a telescoping section for a wellbore test instrument which does not require cable yo-yoing.

It is desirable to have a wellbore instrument, such as a formation fluid pressure and/or sampling instrument, which enables substantially continuous motion of a well logging conveyance in order to prevent sticking and reduce the duration of wellbore operations. This combination of a wellbore instrument in a continuous motion enables economically combining wellbore options, such as a combined pressure/fluid sample test instrument with other types of well logging instruments that make measurements while moving along the wellbore. Typically, such "moving measurements" have not been combined with formation pressure and sampling instruments to operate simultaneously because the former are adapted to make measurements while moving along the wellbore, and the latter, as previously explained, must be stopped. Examples of the former include, without limitation, acoustic devices, resistivity devices and nuclear porosity and lithology measuring devices.

SUMMARY OF INVENTION

One aspect of the invention is a well logging instrument which includes a lower housing having therein a formation testing system adapted to be operated in an axially fixed position in a wellbore. The instrument also includes an upper housing adapted to be operatively coupled to a well logging conveyance. The instrument includes an axial extension mechanism operatively coupled between the lower housing and the upper housing. The extension mechanism is adapted to controllably extend and retract to lengthen and shorten the instrument, respectively.

A method for testing an earth formation according to another aspect of the invention includes moving a logging instrument axially along a wellbore by operating a logging conveyance coupled to an upper end of the instrument. A testing system adapted to test the earth formation at a fixed axial position along the wellbore is deployed, while continuing to move the conveyance along the wellbore. A length of the logging instrument between the conveyance and the testing system is increased by operating an axial extension mechanism disposed between the conveyance and the testing system, while continuing to move the conveyance along the wellbore. The earth formation is tested, the testing system is retracted; and the axial extension mechanism is then retracted. In one embodiment, tension between the instrument and the conveyance is measured, and the axial extension mechanism is extended at a rate adapted to maintain the tension substantially constant.

Other aspects and advantages of the invention will be apparent from the following description and the appended claims.

DETAILED DESCRIPTION

Figure 1:
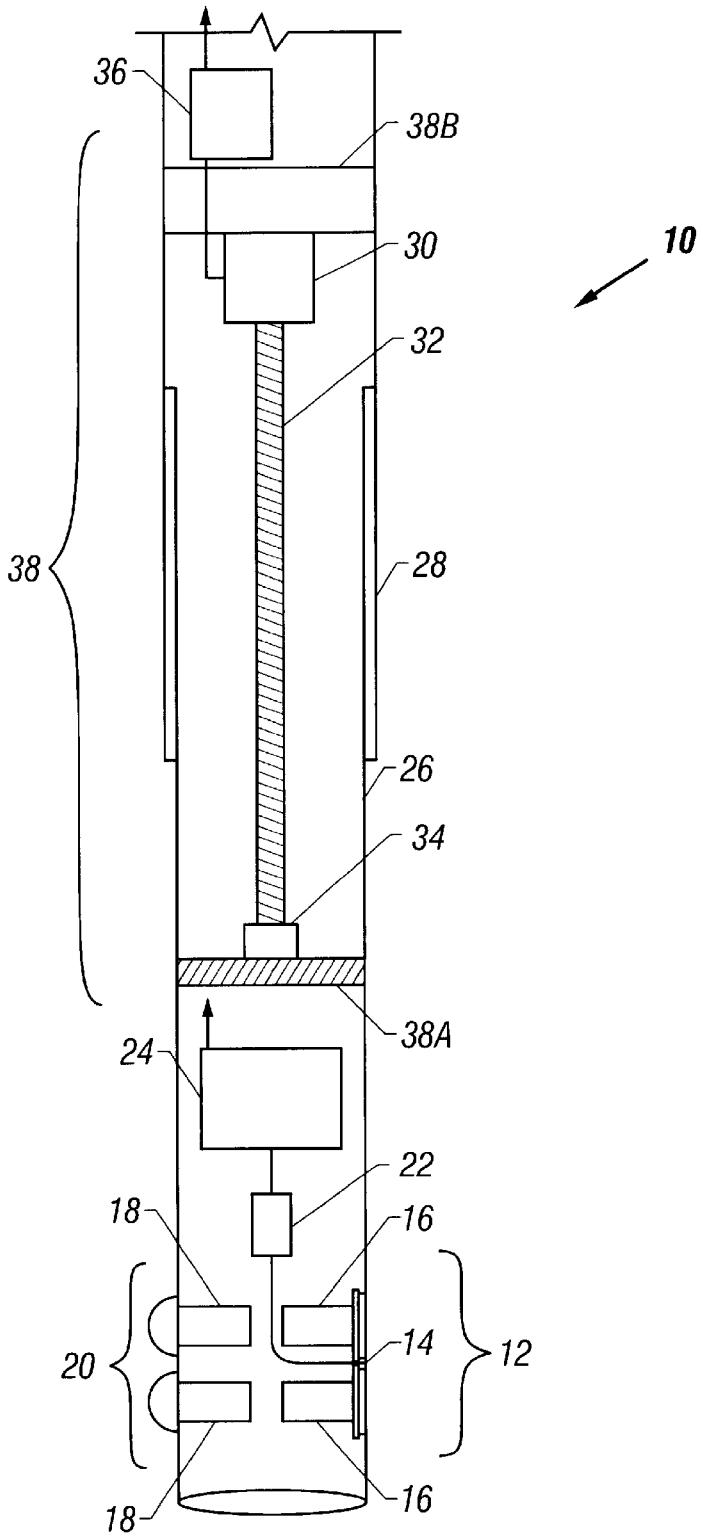
FIG. 1 shows an example embodiment of a formation testing instrument according to one aspect of the invention.

An embodiment of a formation testing instrument is shown schematically in FIG. 1. The instrument 10 in this embodiment is adapted to make formation pressure measurements and/or take fluid samples from an earth formation. Formation fluid pressure measuring/sample taking devices are a principal example, but only one example, of a type of formation testing system which is adapted to perform its testing function while in an axially fixed position within a wellbore.

The instrument 10 includes an upper housing 28 adapted to couple at its upper end to an instrument conveyance, which in this example is an armored electrical cable (not shown). Connection to the cable (not shown) can be either directly, or through other intervening well logging instruments (not shown in FIG. 1 for clarity). The upper housing 28 is adapted to slidingly, sealingly engage a lower housing 26.

The lower housing 26 in this embodiment includes therein the various components of a testing and sampling system 12. The system 12 includes a probe 14 which is adapted to be extended laterally from the lower housing 26 by hydraulic cylinders 16 or the like, and may include a back up pad system 20 located circumferentially opposite the probe 14 about the lower housing 26. The back up pad system 20 can be of any type well known in the art adapted to provide the probe 14 with adequate ability to be sealingly forced against the wall of a wellbore (not shown) in which the instrument 10 is disposed, particularly when the wellbore has a large diameter as compared with the diameter of the instrument 10. The back up pad section 20 can be extended and retracted using hydraulic cylinders 18 or the like.

The probe 14 is in selective hydraulic communication with a pressure testing cylinder 22 having therein a pressure transducer (not shown separately) which makes measurements of the fluid pressure of the selected earth formations adjacent to the wellbore. The pressure testing cylinder 22 may be operatively controlled by a controller/telemetry unit 24, which operates the pressure testing cylinder 22 and records, formats and/or transmits measurements made by the transducer (not shown) so fluid that pressure of the selected earth formations can be determined. Systems including the system 12, pressure test cylinder 22 and transducer therein, controller/telemetry unit 24 and the back up pad system 20 may be any one or more of a number of types well known in the art, such as disclosed, for example, in U.S. Pat. No. 6,058,773 issued to Zimmerman et al. and U.S. Pat. No. 4,936,139 issued to Zimmerman et al. The type and structure of the system 12, pressure test cylinder 22, controller/telemetry unit 24 and the back up pad system 20 are only provided to help explain the invention, and are not in any way intended to limit the scope of the invention.

The system 12 of FIG. 1 is depicted as a formation fluid pressure measuring/sample taking system with a probe and hydraulic cylinders. However, the system may be substituted with any downhole instrument capable of performing operations in the apparatus 10. Example of such downhole instruments include devices, such as a rotary or percussion "core" sampling device, perforation tools, rock testing and sampling tools as well as others instruments usable with downhole tools.

As previously explained, the upper housing 28 and the lower housing 26 are adapted to slidingly, preferably sealingly, engage each other. An axial position of the upper housing 28 with respect to the lower housing 26 is controlled, in various embodiments of the invention, by an axial extension mechanism 38. One end of the axial extension mechanism 38 is fixedly coupled to a selected position along the lower housing 26, such as at lower bulkhead 38A. The other end of the axial extension mechanism 38 is fixedly coupled to a selected position along the upper housing 28, such as at upper bulkhead 38B.

The embodiment of the axial extension mechanism 38 shown in FIG. 1 may include an electric motor 30 the rotary output of which turns an extension screw, or ball screw 32. The ball screw 32 engages a ball nut 34 fixed to the lower bulkhead 38A or other element coupled to the lower housing 26. The motor 30 in this embodiment is controlled by a motor controller 36, functionality of which will be further explained. To summarize, the motor 30 may be turned to rotate the ball screw 32 to cause the lower housing 26 to slide outward from the upper housing 28 (or as may be described inversely, the upper housing 28 slides outwardly from the lower housing 26). The outward relative sliding lengthens the instrument 10. The motor 30 may also be turned in the opposite direction to ultimately cause the housings 26, 28 to slide together with respect to each other, to shorten the instrument 10.

As will be appreciated by those skilled in the art, when the pressure testing system 12 is engaged with the wall of a wellbore (not shown) to make a pressure test of an earth formation, its axial position in the wellbore (not shown) is fixed. By causing the motor 30 to operate to lengthen the instrument 10, the cable (not shown) and any intervening logging instruments (not shown) may continue to move along the wellbore (not shown). After a pressure measurement is made, and the pressure measuring system 12 is retracted, the motor 30 may be operated to cause the instrument 10 to shorten, still while moving the cable and any intervening logging instruments.

Figure 2:
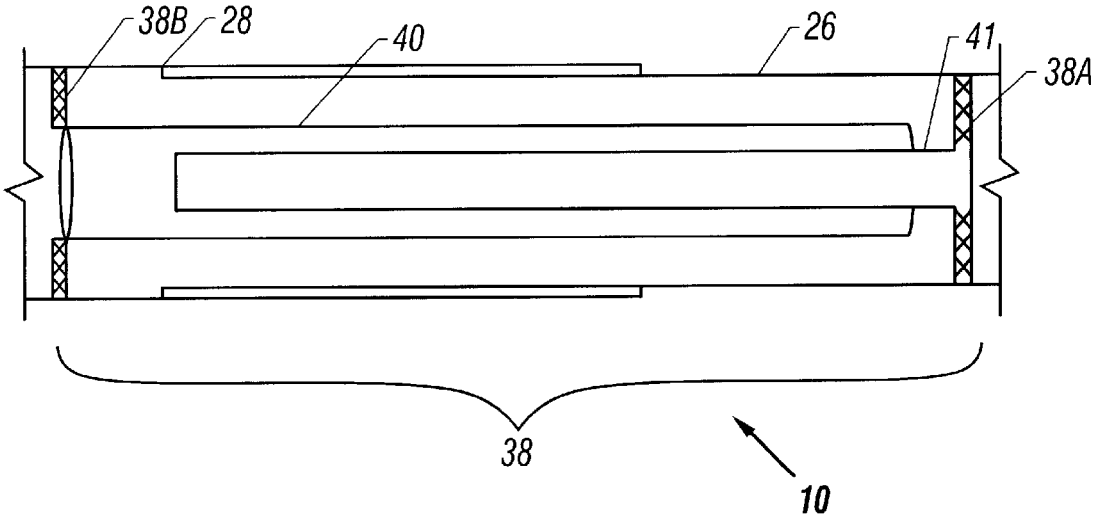
FIG. 2 shows another embodiment of an axial extension mechanism according to one aspect of the invention.

Another possible embodiment of the axial extension mechanism 38 is shown in FIG. 2. In this embodiment, the axial extension mechanism includes an hydraulic cylinder 40 coupled at one end to bulkhead 38B in the upper housing 28, and an hydraulic piston 41 coupled at one end to bulkhead 38A in the lower housing 26. The piston 41/cylinder 40 combination may be any conventional type adapted to extend and retract the piston 41 from the cylinder 40 upon application of suitable hydraulic pressure. The piston 41/cylinder 40 combination should be operatively coupled to a suitably controlled hydraulic pressure source (not shown) to extend and retract the piston 41 from the cylinder 40 to lengthen and shorten the instrument 10 as explained with respect to the previous embodiment of the axial extension mechanism 38.

Figure 3:
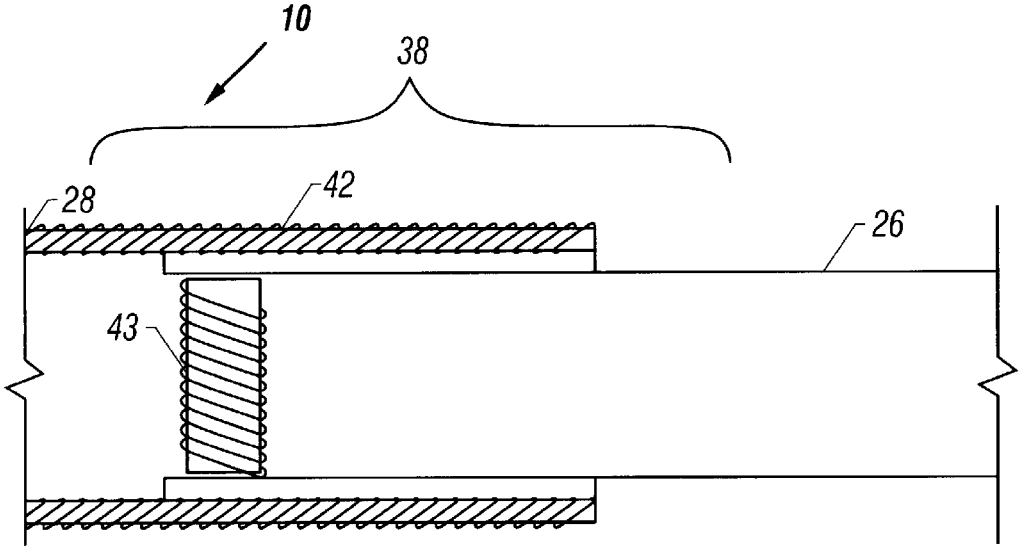
FIG. 3 shown another embodiment of an axial extension mechanism according to one aspect of the invention.

Another possible embodiment of the axial extension mechanism 38 is shown in FIG. 3. This embodiment is a linear electric actuator including a primary winding 43 mechanically coupled to the lower housing 26 and a secondary winding 42 mechanically coupled to the upper housing 28.

For any embodiment of the axial extension mechanism, such as the ones described above, it is understood that the positions of the various elements of any embodiment of the mechanism 38 described above within either of the upper housing 28 and lower housing 26 are only to illustrate the general principle of an instrument made according to this aspect of the invention. Accordingly, the relative positions of the various components of the axial extension mechanism shown herein are not meant to limit the invention. For example, the motor 30 and balls crew 32 of FIG. 1 could as easily and effectively be located in an coupled to the lower housing 26. It is also understood that having the lower housing 26 be adapted to slide within the upper housing 28 as shown in FIGS. 1, 2 and 3 is also meant only to illustrate the principle. The upper housing 28 could as easily be adapted to slide within the lower housing 26 while performing as intended within the scope of the invention.

A method of performing wellbore operations according to the invention is illustrated in FIGS. 4 through 8. Specifically, FIGS. 4 through 8 show a method of taking pressure measurements and/or fluid samples. FIGS. 4 through 8 also show how the overall length of the instrument 10 extends and retracts over time.

Figures 4, 5, 6, 7, 8:
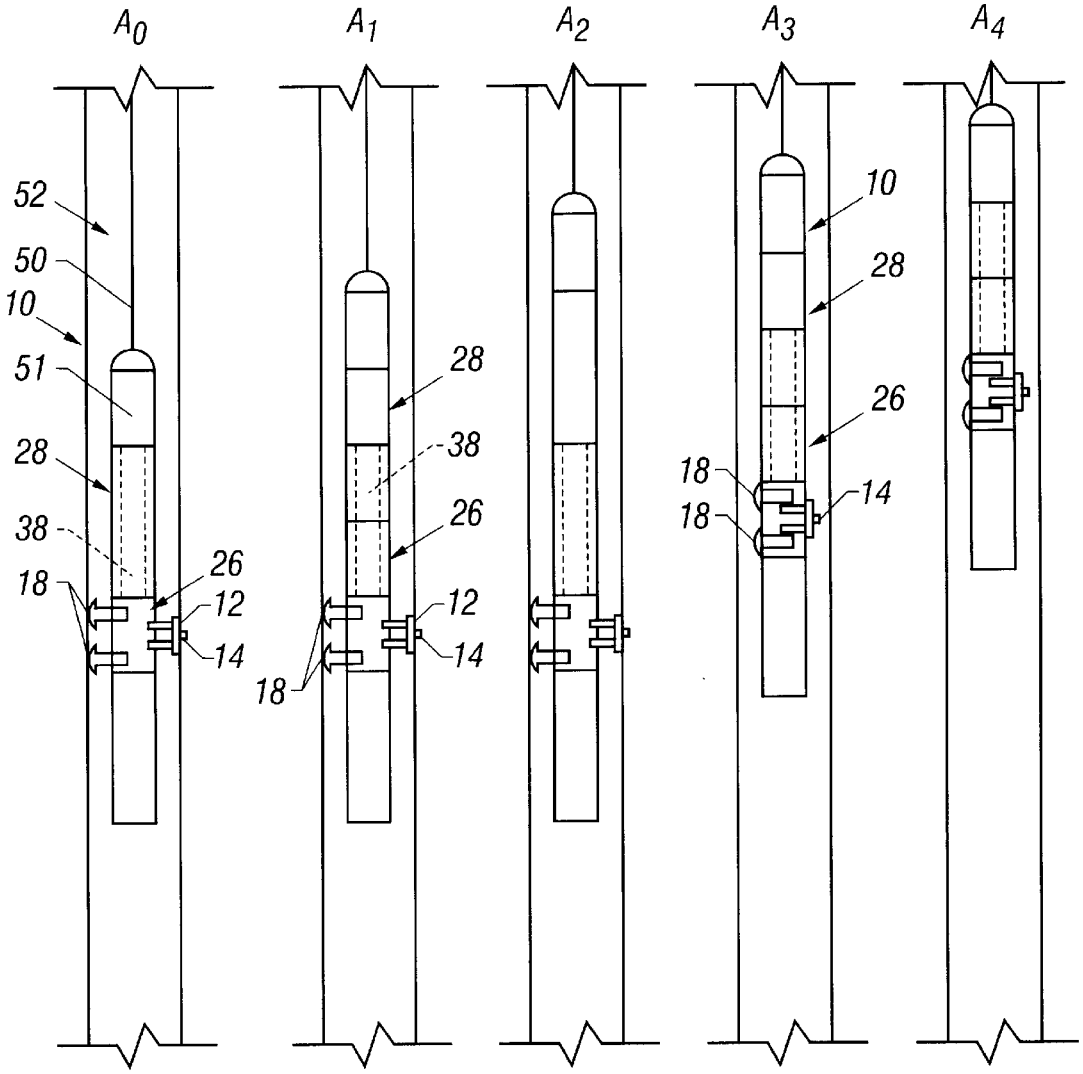
FIGS. 4–8 show a well logging/pressure testing operation according to another aspect of the invention.

In FIG. 4, an instrument 10 according to the invention is coupled to a well logging cable 50. The instrument 10 has an upper housing 28 coupled to the cable 50 through an intervening logging instrument 51 adapted to make one or more types of petrophysical measurements while the intervening instrument 51 is moved along the wellbore 52. The instrument 10 also has a lower housing 26 coupled to the upper housing 28 as previously described. Other embodiments of a method according to the invention may exclude the intervening logging instrument 51. FIG. 4 shows the instrument 10 at initial time to with the axial extension mechanism fully retracted. The test system 12 is deployed in an earth formation which is intended to be tested, and the various components of the test system 12 which are adapted to contact the wellbore 52 are placed in contact therewith.

FIG. 5 shows the tool as it has advanced up the wellbore at a time $t_1$. The logging cable 50 continues to be withdrawn from the wellbore 52, in some embodiments, at substantially the same rate as prior to deployment of the test system 12. As the cable 50 continues to be withdrawn, the axial extension mechanism 38 is operated to enable the upper housing (28 in FIG. 1) to continue to move at the same rate as the cable 50. The lower housing (26 in FIG. 1) remains axially fixed within the wellbore 52.

FIG. 6 show the tool at time $t_3$. The lower housing 26 of the instrument 10 is stopped with the system 12 deployed to perform wellbore operations. Upper housing 28 continues to advance uphole thereby increasing the overall instrument 10 length as shown in FIG. 6 as the pressure test system 12 is operated to make at least one fluid pressure test from the surrounding earth formation.

FIG. 7 shows the instrument 10 at time $t_4$. In FIG. 7, the pressure test is completed, and the pressure test system is retracted to enable resumed upward motion of the lower housing 26 having the pressure test system 12 therein. The lower housing 26 of the instrument 10 is released from the wellbore and begins to retract into the upper housing and the overall length of the tool 10 begins to decrease. The lower housing is retracted by operating the axial extension mechanism 38 to shorten the instrument length as discussed previously.

FIG. 8 shows the instrument 10 at time $t_4$. In FIG. 8, the lower housing 26 is fully retracted and the overall instrument length is returned to its original, retracted length at $t_1$. The tool may then be moved into another position within the wellbore to take additional tests, or be withdrawn from the borehole.

Figures 9, 10, 11, 12, 13:
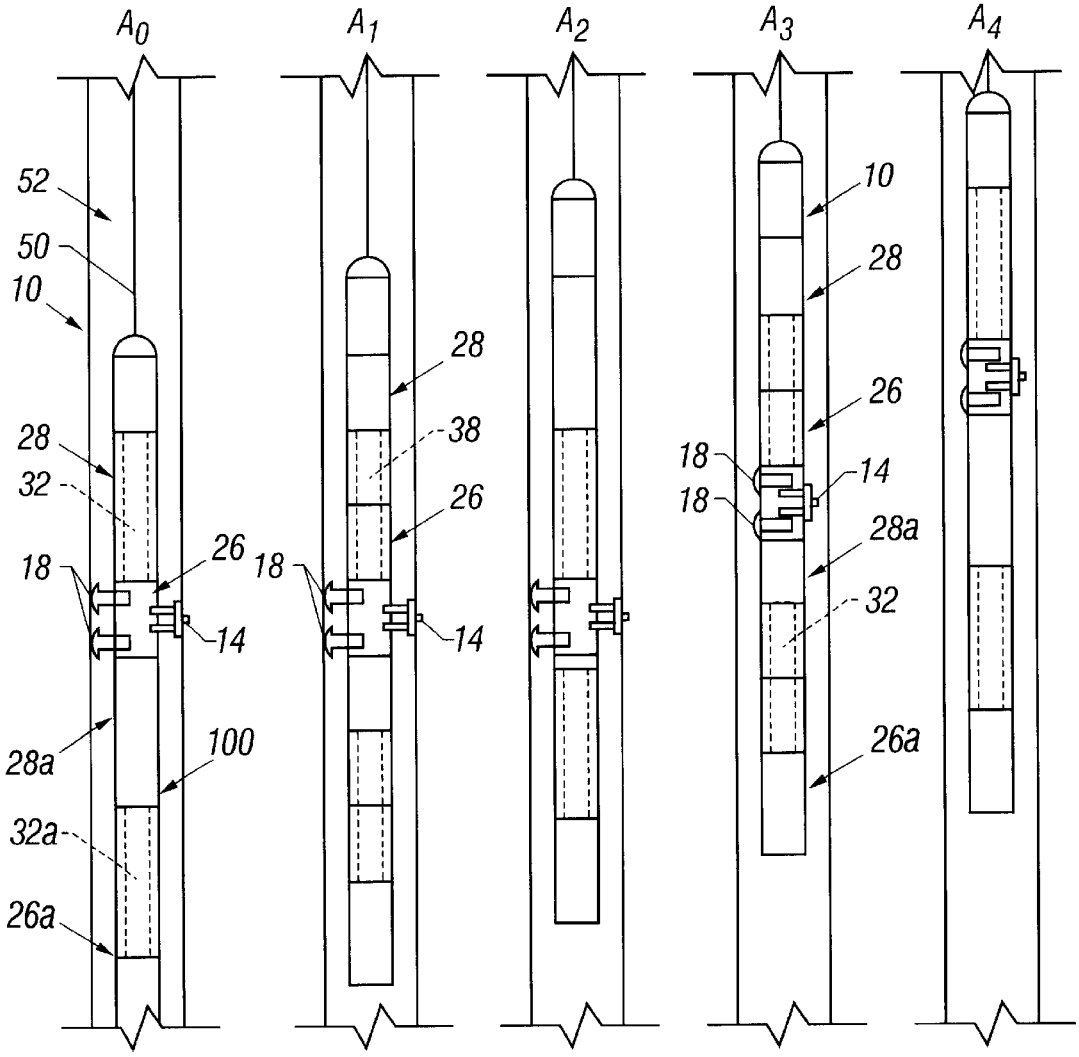
FIGS. 9–13 show a well logging/pressure testing operation according to another aspect of the invention.

Referring now to FIG. 9, the instrument 10 is shown in combination with an extender 100. The extender 100 has an upper portion 28*a* coupled to the lower housing 26 of instrument 10, and a lower portion 26*a*. The upper portion 28*a* and the lower portion 26*a* having an axial extension mechanism 38*a* adapted to axially extend and retract upper portion 28*a* and lower portion 26*a* as previously described with respect to axial extension mechanism 38 of FIGS. 1 through 3. The lower portion 26*a* of the extender 100 may optionally be provided with additional instruments to perform tests.

A method of performing wellbore operations using the instruments 10 with the extender 100 is illustrated in FIGS. 9 through 13. FIGS. 9 through 13 show the instrument 10 advance up the wellbore as previously described with respect to FIGS. 4 through 8. At time $t_0$, the instrument 10 is in the fully retracted position and the extender 100 is in the fully extended position. As shown in FIG. 10 and at time $t_1$, the upper housing 28 of the instrument 10 and the lower portion 26*a* of the extender 100 have begun to move uphole. At time $t_2$ of FIG. 11, the instrument 10 is in the fully extended position, and the extender 100 is in the fully retracted position. FIG. 12 shows the instrument 10 at time $t_3$ with the sampling probe 14 having completed its test. The instrument 10 begins to retract while the extender 100 begins to extend. At time $t_4$ shown in FIG. 13, the instrument 10 has fully retracted and the extender 100 has fully extended. The cycle may then begin again at another position in the wellbore.

FIGS. 9 through 13 depict the instrument 10 extending while the extender 100 retracts and the extender 100 extending as the instrument 10 retracts. This depiction of the instrument 10 operating at alternate intervals with the extender is one example of an operation with multiple extension mechanisms. The instrument and extender may be timed to operate simultaneously, out of sync, or at any desired interval.

Figures 14, 15, 16, 17, 18, 19:
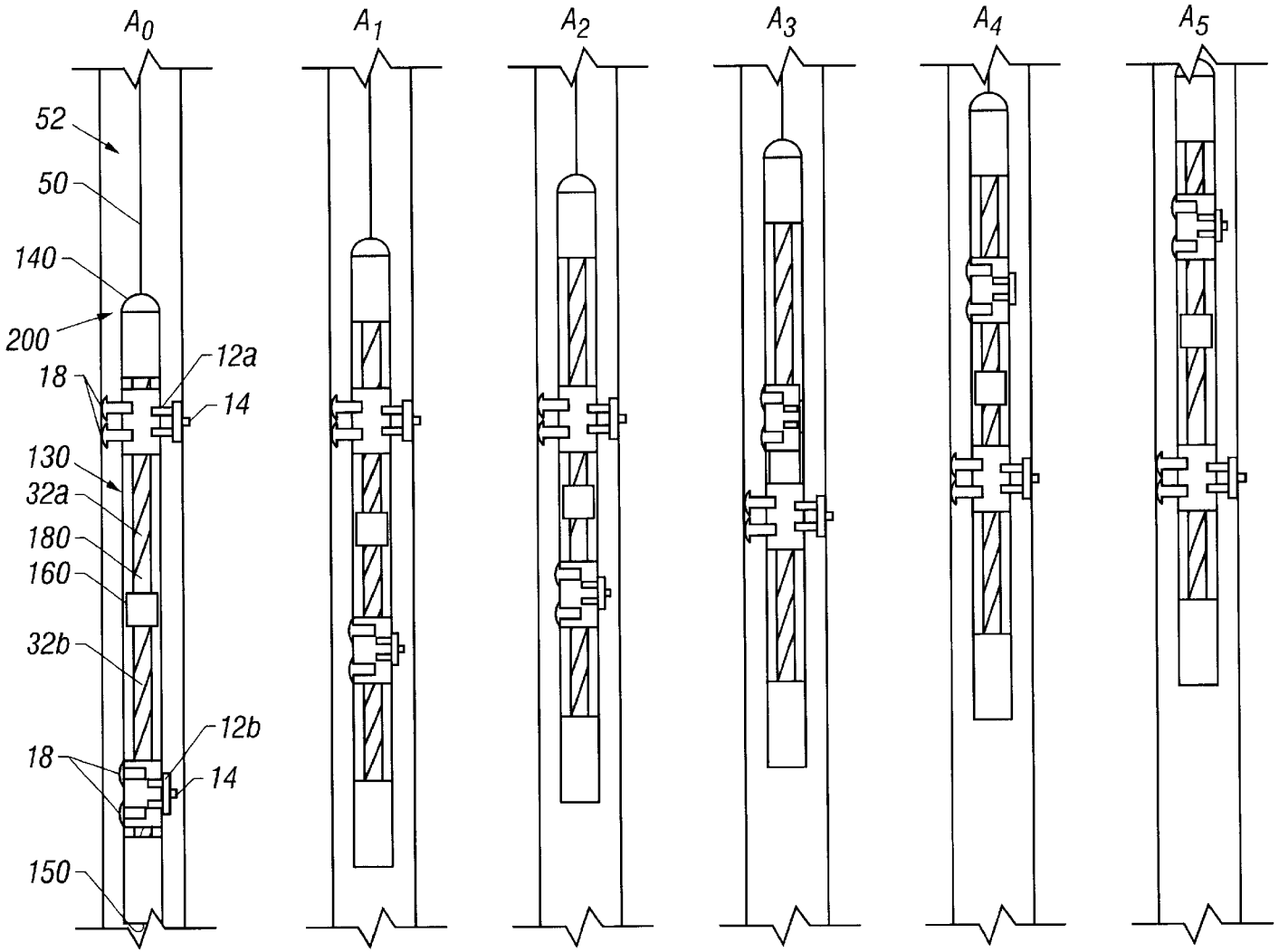
FIGS. 14–19 show a well logging/pressure testing operation according to another aspect of the invention.

Another embodiment of the present invention is depicted in FIG. 14. The instrument 200 is provided with a slotted housing 130 having an upper end 140 and a lower end 150. An axial mechanism 180 having an upper portion 32*a* and a lower portion 32*b* is disposed within the housing. A mechanical stop 160 is disposed between the upper portion 32*a* and the lower portion 32*b*.

An axially movable testing systems 12*a* is positioned on upper portion 32*a*, and an axially movable testing system 12*b* is positioned on lower portion 32*b*. Each testing system is provided with a probe 14 and opposing back up pad section 18 extendable through slots (not shown) in the housing 130. The testing systems 12*a* and 12*b* are axially movable along their respective portion of the axial mechanism 180.

A method of performing wellbore operations using the instrument 200 in accordance with the invention is illustrated in FIGS. 14 through 19. The instrument 200 is shown progressing uphole in the wellbore 52 from time $t_0$ of FIG. 15 to time $t_5$ of FIG. 20. As shown in FIGS. 14 through 16 at times $t_0$ through $t_2$, the testing system 12*a* extends through the slot (not shown) in the housing and engages the wellbore 52 to perform a testing function. Testing system 12*a* advances toward mechanical stop 160 along the upper portion 32*a* of the axial mechanism 180, and the testing system 12*b* advances toward mechanical stop 160 along the lower portion 32*b* of the axial mechanism 180.

Referring now to FIG. 17 at time $t_3$, testing system 12*a* retracts back into the housing, and testing system 12*b* extends through the slotted housing to perform a test. As the instrument 200 continues uphole as shown in FIG. 18 at time $t_4$, instrument 12*b* advances towards the lower end 150 of the instrument, and testing system 12*a* advances toward the upper end 140 of the instrument 200. As shown in FIGS. 14 through 19, testing systems 12*a* and 12*b* test at alternate intervals, but could be timed at alternate, simultaneous or random intervals to perform a variety of tests.

It is understood that reference to a well logging cable as explained with respect to FIGS. 4–19 are merely examples of a well logging conveyance which may be used in various embodiments of an instrument and method according to the invention. Coiled tubing and drill pipe logging conveyances may also be used in other embodiments.

Figure 20:
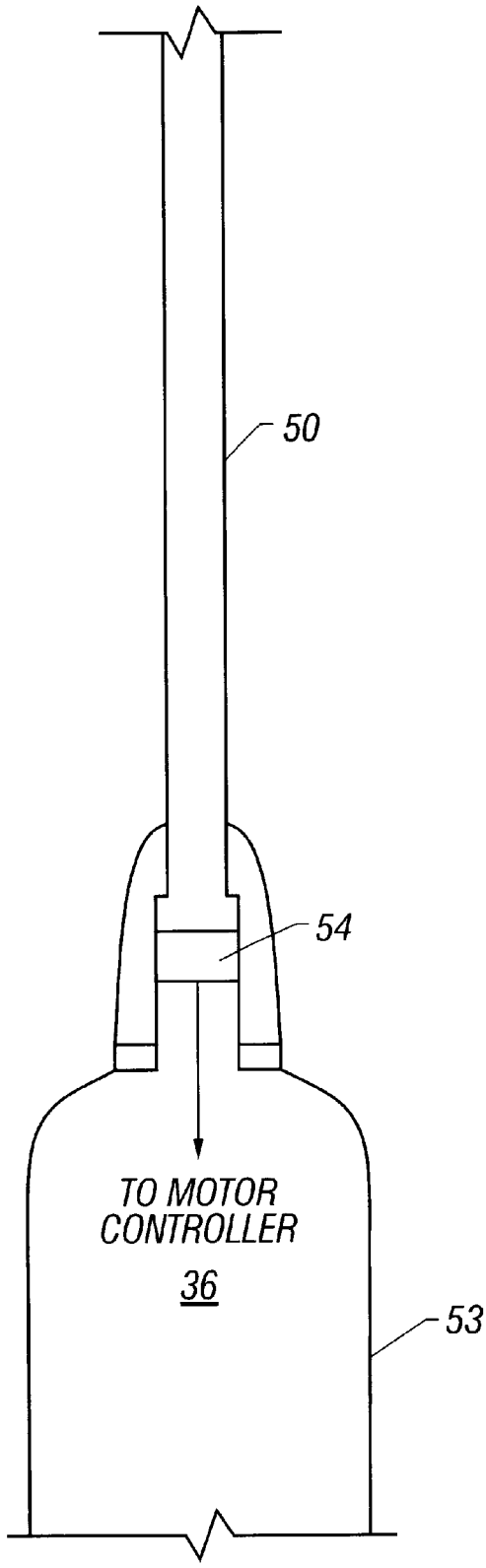
FIG. 20 shows an example embodiment of a cable tension measuring device used in another aspect of the invention.

Another aspect of the invention can be better understood by referring to FIG. 20. FIG. 20 shows a typical cable head 53 which is used to make electrical and mechanical connection between the logging cable 50 and the instrument (10 in FIGS. 4–9). This embodiment of the cable head 53 includes therein a sensor 54 having an output related to the amount of tension between the logging cable 50 and the cable head 53. As will be appreciated by those skilled in the art, the instrument upper housing (28 in FIG. 1) synchronously moves with the cable even when the lower housing (26 in FIG. 1) is axially fixed in the wellbore, as explained with respect to FIGS. 4–9. If the cable motion matches the rate at which the axial extension mechanism (38 in FIGS. 4–9) increases the instrument length, the tension between the cable head 53 and the cable should remain substantially constant. In this embodiment of the invention, the sensor 54 is operatively coupled to the motor controller (36 in FIG. 1), and the controller is adapted so that the rate of extension of the axial extension mechanism 38 may be substantially matched to the rate of motion of the logging cable 50. If the cable 50 moves faster than the extension mechanism 38 lengthens, it would be expected that the tension indicated by the sensor 54 will increase, and vice versa.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A well logging instrument, comprising:

a lower housing having therein a wellbore testing system adapted to be operated in an axially fixed position in a wellbore;

an upper housing adapted to be operatively coupled to a well logging conveyance; and an axial extension mechanism operatively coupled between the lower housing and the upper housing, the extension mechanism adapted to controllably extend and retract so as to controllably lengthen and shorten the instrument, respectively.

2. The instrument as defined in claim 1 wherein the axial extension mechanism comprises a motor having a ball screw operatively coupled thereto, and a ball nut operatively coupled to the ball screw.

3. The instrument as defined in claim 1 wherein the axial extension mechanism comprises an hydraulic cylinder and piston combination.

4. The instrument as defined in claim 1 wherein the axial extension mechanism comprises an electric linear actuator.

5. The instrument as defined in claim 1 further comprising a controller operatively coupled to the axial extension mechanism and a sensor having an output related to a tension on the well logging conveyance, the controller adapted to operate the extension mechanism so as to maintain a substantially constant tension on the well logging conveyance.

6. The instrument as defined in claim 1 wherein the conveyance comprises a well logging cable.

7. The instrument as defined in claim 1 wherein the testing system is selected from the group of a formation pressure testing system, a formation sampling system, a rock indentation system and a perforating system.

8. The instrument as defined in claim 1 further comprising a well logging device coupled between the conveyance and the upper housing, the well logging device adapted to make measurements while moving along the wellbore.

9. The instrument as defined in claim 1 further comprising an extender.

10. The instrument as defined in claim 9 wherein the extender comprises an upper portion, a lower portion, and a second axial extension mechanism operatively coupled therebetween, the upper portion coupled to the lower housing; the extension mechanism adapted to controllably extend and retract so as to controllably lengthen and shorten the extender, respectively.

11. The instrument as defined in claim 10 having therein a second wellbore testing system.

12. A well logging instrument, comprising:

a housing disposable in a wellbore, the housing having axial slots therethrough;

an axial mechanism positioned within the housing; and a wellbore testing system movably positionable along the axial mechanism, the testing system adapted to extend through the slots of the housing and perform wellbore tests as the housing advances through the wellbore.

13. A method for testing an earth formation, comprising:

(a) moving a logging instrument axially along a wellbore by operating a logging conveyance coupled to an upper end of the instrument;

(b) deploying a testing system adapted to test formation parameters at a fixed axial position along the wellbore;

(c) extending a length of the logging instrument by operating an axial extension mechanism disposed between the conveyance and the testing system;

(d) testing the formation;

(c) retracting the testing system; and (f) retracting the axial extension mechanism, wherein the deploying, extending the length, testing the formation and retracting the testing system and extension mechanism are performed while continuing to move the conveyance along the wellbore.

14. The method as defined in claim 13 wherein the extending comprises operating a motor and ball screw.

15. The method as defined in claim 13 wherein the extending comprises operating an hydraulic cylinder and piston.

16. The method as defined in claim 13 wherein the extending comprises operating an electric linear actuator.

17. The method as defined in claim 13 further comprising measuring a tension between the conveyance and the instrument, and controlling a rate of the extending to maintain the tension substantially constant.

18. The method as defined in claim 13 further comprising making a measurement of at least one formation property from an instrument adapted to move synchronously with the conveyance, the making the measurement continuing while extending the length of the logging instrument.

19. The method as defined in claim 13 wherein the moving the conveyance comprises withdrawing a well logging cable from the wellbore.

20. The method as defined in claim 13 wherein the step of moving a logging instrument comprises moving a wellbore tool comprising multiple logging instruments axially coupled together axially along a wellbore by operating a logging conveyance coupled to an upper end of the tool, and wherein steps (b)–(f) are performed for each instrument.

21. The method as defined in claim 20 wherein the multiple instruments perform steps (b)–(f) alternately with adjacent instruments.

22. The method as defined in claim 20 wherein the multiple instruments perform steps (b), (d) and (c) simultaneously.

* * * * *